United States Patent [19]

Wizon

[11] 3,976,746

[45] Aug. 24, 1976

[54] GRAPHITIC FIBERS HAVING SUPERIOR COMPOSITE PROPERTIES AND METHODS OF MAKING SAME

[75] Inventor: Irvin Wizon, Huntington Beach, Calif.

[73] Assignee: Hitco, Irvine, Calif.

[22] Filed: June 6, 1974

[21] Appl. No.: 477,079

[52] U.S. Cl. ..... 423/447.8; 106/307; 264/29.2

[51] Int. Cl.[2] ..... C01B 31/07

[58] Field of Search ..... 423/447, 460; 106/307; 264/29

[56] References Cited

UNITED STATES PATENTS

| | | | |
|---|---|---|---|
| 3,612,819 | 10/1971 | Gibson | 423/447 X |
| 3,652,221 | 3/1972 | Sloka | 423/447 |
| 3,716,331 | 2/1973 | Schalamon | 423/447 |
| 3,720,536 | 3/1973 | Scola et al. | 117/47 R |
| 3,723,150 | 3/1973 | Druin et al. | 423/447 X |
| 3,746,560 | 7/1973 | Goan et al. | 423/447 X |
| 3,754,957 | 8/1973 | Druin et al. | 106/307 |
| 3,769,390 | 10/1973 | Weisbeck et al. | 423/447 |
| 3,853,610 | 12/1974 | Byrne et al. | 423/447 X |
| 3,894,884 | 7/1975 | Druin et al. | 423/447 X |

FOREIGN PATENTS OR APPLICATIONS

| | | | |
|---|---|---|---|
| 1,222,881 | 2/1971 | United Kingdom | 423/447 |
| 1,238,308 | 7/1971 | United Kingdom | 423/447 |

*Primary Examiner*—Edward J. Meros
*Attorney, Agent, or Firm*—Fraser and Bogucki

[57] ABSTRACT

At least partially carbonized fibers formed by pyrolysis from precursor fibers are converted to graphitic fibers in successive heating and stretching zones in which a transitional phase of high fiber reactivity is utilized. Chemical agents applied to the fibers during this transition increase matrix-fiber adhesion properties by reacting with the fibers before they develop excessive levels of crystallographic order and become inert at graphitization temperature levels. Improved control of fiber properties is achieved by employment of short residence times and resistive heating with concurrent stretching in the zones, and by imparting high stretch levels at relatively low temperatures to the fibers. The resultant fibers have superior properties for component structures and at the same time have excellent tenacity and modulus values as well.

19 Claims, No Drawings

GRAPHITIC FIBERS HAVING SUPERIOR COMPOSITE PROPERTIES AND METHODS OF MAKING SAME

BACKGROUND OF THE INVENTION

1. Field of the Invention

The present invention relates generally to the conversion of precursor fibers to graphitic fibers by pyrolysis, and more particularly to processes for improving surface reactivity of graphitic fibers in order to provide better adhesion of such fibers within a resin matrix so as to obtain superior composite properties, and to fibers provided by such processes.

2. History of the Prior Art

As set forth in detail in a co-pending application of Irvin Wizon, METHODS OF FABRICATING GRAPHITIC FIBERS AND FIBERS PROVIDED THEREBY, Ser. No. 315,658, filed Dec. 15, 1972, now abandoned, and assigned to the same assignee as the present application, carbon fibers can advantageously be converted to a graphitic state with particular fiber characteristics by the use of two or more controlled temperature and concurrent stretching zones. It is shown that the orientation potential of the microfibrillar structure of the fibers has substantial responsiveness to stretching in a lower temperature first zone, which largely controls tensile strength. Some further fibrillar orientation is obtained by stretching in a second thermal treatment zone, but in this zone the control is primarily that of crystallographic order and essentially controls the modulus of elasticity. It is shown that there is an interrelationship between the temperatures and the stretches that are used in the various zones. At the same time, it is observed that the chemical reactivity of the resultant fibers is related to treatment in the two zones, and in particular to the temperatures used in the later treatment zones.

It had previously been thought by workers in the art that a marked reduction in surface reactivity was a necessary incident of precursor characteristics and the graphitic conversion process, over which little if any control could be exercised. Workers in the art have heretofore concentrated on obtaining relatively slight improvements in the surface reactivity of graphite fibers by post treatment of the fibers. A few of the many examples available are found in the use of an acid (e.g. U.S. Pat. No. 3,660,140), oxygen (e.g. U.S. Pat. No. 3,720,536), or a catalyst (e.g. U.S. Pat. No. 3,627,570). Such techniques are specifically utilized to enhance surface adhesion properties. A number of proposals have been made to control the graphitization atmosphere in a selected fashion, for various purposes, as in U.S. Pat. Nos. 3,532,465, 3,723,605, 3,656,903 and 3,116,975. The prior art, however, does not provide a significant basis for substantial improvements in the composite properties of graphitic fibers. The characteristics of a composite using graphitic fibers, for example, are determined not only by the surface adhesion between the matrix and the fibers, but also by other parameters such as the modulus and tensile strength of the fibers. Thus none of the characteristics can be permitted to be significantly degraded, but modulus and tensile must be maintained at desired levels while composite properties such as transverse tensile and shear strengths are markedly improved to meet the needs of the composite structures art.

SUMMARY OF THE INVENTION

In accordance with the present invention, carbonaceous fibers are stretched in at least two successively higher temperature zones during conversion to graphitic fibers a transitional phase in or between the zones is established in which the fibers are reactive and receptive to treatment with reagents, prior to diminution of reactivity with higher temperature as the fibers approach a completely graphite state. Reagents effective during early stages of transition of the fibers toward the graphitic state provide polar sites at the filament surfaces and can also tend to inhibit graphitization. This results in superior fiber-matrix adhesion and substantially improved composite properties.

Methods in accordance with the invention preferentially employ short span, high thermal gradient resistive heating of the fibers, during pyrolysis from a partially carbonaceous but conductive initial state to a final state at which a desired level of graphiticity is reached. Temperatures in a first firing zone are preferably limited to below 1900° C., while stretch in relation to initial length is in excess of approximately 15%. At this point in the transitional sequence, significant surface reactivity exists and the orientation imparted to the fibers by the stretch builds a base for substantial tensile strength. Further stretch at a higher temperature in the presence of an inhibiting agent maintains reactivity and can impart further tensile properties, but primarily increases modulus values. It is preferred to limit temperatures in the final zone to below conventional graphitization temperatures, or not in excess of approximately 2800° C. unless very high modulus, relatively low surface reactivity fibers are desired. The electrical resistance, short duration and internal heating of the fibers permits development of both internal orientation and crystallographic order, while polar sites are created on the fiber surface for improved adhesion.

In a specific example of a sequence in accordance with the invention, a continuous strand or yarn of carbonaceous fibers of cellulosic origin, initially carbonized to a temperature of approximately 400° C. so as to be 75–80% carbon, is passed through an electrode roller system to provide at least two electrically resistively heated spans of relatively short length, the residence times being of the order of 1 second and 0.25 second respectively. The first zone temperature is at a substantially fixed level of approximately 1830° C., while the stretch is approximately 20% of the starting length. In the second zone a fixed level temperature of approximately 2730° C. and stretch of about 15% of prior length are used. Between the two spans, the continuous length is passed through a bath containing a liquid reagent comprising an aqueous solution of salt or acid. The reagent volatilizes or induces an in situ reaction when the fibers are in the subsequent temperature zone to inhibit lattice development at and adjacent the surface, and create polar sites in the resultant fiber. When graphitic fibers thus prepared are unified in a composite structure with a resin matrix, remarkable improvements in significant composite properties such as transverse tensile and shear are obtained.

DETAILED DESCRIPTION OF THE INVENTION

Previously referenced patent application Ser. No. 315,658 discusses how a "wrinkled ribbon" structure hypothesized in the prior art can be advantageously altered by mechanical distortion or stretch, as opposed to mere tension, in at least two distinct temperature regions above 1300° C. Such application describes how tensile dominant and modulus dominant zones may be utilized to advantage, by interrelationships of temperature levels and stretch conditions, to achieve selectively controllable combinations of tensile and modulus values. Further, Examples VI and VII therein show how substantial increases in composite properties may be obtained while preserving the tensile and modulus values. As set forth in the referenced application, these results are achieved in part by the use of a lower final temperature, inasmuch as the fibers become more inert with higher final temperatures. It is also shown that the usage of a reduced amount of stretch in the second zone acts synergistically with the lowering of final temperature to achieve significant increases in composite properties. The referenced application further describes the preferred usage of a continuous process employing short span, resistive heating with concurrent stretching utilizing the apparatus essentially described in U.S. Pat. No. 3,612,819.

Because of the many variables that affect fiber temperature in a short span resistive heating process, including fiber composition and diameter, out-gassing dynamics, atmosphere and process rate, as well as cross-sectional temperature gradients within the fiber, temperatures sensed by pyrometric and other techniques can only be estimated. Thus the term "process temperature" is used in the referenced application and in this application to set forth the results of these calculations and measurements for particular conditions. A much more readily observable and measurable value is the amperage used in heating the strand, and this is given in each instance as well.

In accordance with the present invention, significant further improvements in resultant composite properties are achieved by employment of the thermal and stretch variables, in a fashion to create and take advantage of a transitional phase in or between zones in which the fibers are highly reactive. In or subsequent to this transitional phase, reagents are employed. Reagents may be used in one or both of successive treatment zones, or applied cold between the zones but the action of the reagent takes place concurrently with heating in either or both zones.

It is preferred, but not necessary, to apply the reagent to a continuous strand, such as yarn, as it moves continuously through a liquid bath between a pair of heating and stretching zones, inasmuch as this permits continuous processing. In this sequence, the reagent can either volatilize or react in situ in the subsequent hot zone. Volatilization of an appropriate reagent provides a reactive atmosphere for desired chemical action. However, liquids may also be applied by sprays and other techniques prior to or between zones, or within zones.

The reagents employed in accordance with the invention may comprise oxidants, metal salts, acids and alkalis and organic chemicals including epoxidized saturated and unsaturated fatty acids and glycols, acids and bases. Specific chemicals that have been employed include sodium dichromate, potassium carbonate, potassium dichromate, cobalt sulfate, oxalic acid, and a mixture of nickel nitrate and sodium hypochlorite.

In a generalized example of processes in accordance with the invention, a partially carbonized yarn having an initial value of 75–80% carbon was subjected to the short span electrical resistance heating in two elevated temperature zones as described in referenced patent application Ser. No. 315,658. The fibers were of cellulosic yarn origin, and initially treated by heating to a final temperature of approximately 400° C., so that they became sufficiently high in carbon content to be resistively heated.

Significant advantages are achieved by the use of 400° C. carbonized fibers as starting material for the resistance heating, multi-zone, and chemical reagent process. The usage of resistive heating contributes to uniformity, and shorter residence times contribute appreciably to avoidance of approaching an inert graphite condition too rapidly or uncontrollably. However, the teachings of the invention can be utilized with batch processes and with other heating and stretching techniques by proper observance of temperature levels.

In referenced application Ser. No. 315,658 there is given, as Example VI, a sequence of treatments in which temperature and stretch alone are modified in sequence to increase substantially the transverse tensile and shear properties of graphitic fibers provided by Enka rayon 4400 denier precursor, while maintaining modulus values of $40 \times 10^6$ psi. The results of this sequence are reproduced here for convenience:

Process (from Ser. No. 315,658)

| | | Temperature | Stretch | TVT (psi) | Shear (psi) |
|---|---|---|---|---|---|
| SUBSET A | 1st Zone | 1980° C. | 15% | 2600–2900 | 6500–7200 |
| | 2nd Zone | 2860° C. | 20% | | |
| SUBSET B | 1st Zone | 1955° C. | 15% | 3200–3500 | 8600–8800 |
| | 2nd Zone | 2805° C. | 20% | | |
| SUBSET C | 1st Zone | 1955° C. | 20% | 3800–3900 | 9200–9300 |
| | 2nd Zone | 2805° C. | 15% | | |
| SUBSET D | 1st Zone | 1830° C. | 20% | 4100–4200 | 10300–10400 |
| | 2nd Zone | 2732° C. | 15% | | |

These data show that by reducing the temperature level in the first zone and increasing the proportion of stretch in the first zone, successive improvements in composite properties were obtained through better fiber-matrix adhesion. These improvements in composite properties were determined by fabrication of a fiber-reinforced composite panel and by testing this composite. The method of sample preparation and testing for composite properties was in accordance with accepted procedures, and is here set out in detail for reference. About 2,000 feet of a given yarn were graphitized, under the stated conditions, for each example. This method was utilized in the referenced application and in the testing of products made in accordance with the following specific examples. To standardize surface reactivity conditions, the yarn was then oxidized by resistance heating in air at 960° C. by passage through a 2 in. zone at 43 feet per minute, and immediately coated with an epoxy resin finish, namely UCC4517. Thereafter the graphite yarn was preimpregnated by dipping into the resin while being wound in successive turns on a drum to form a tape. After sufficient drying for the turns to adhere together, the tape was cut transversely into standard lengths, which were then laid up into a laminate of 10 plies. The laminate was placed in a heated press and press cured at 320° F. and 100 psi for two hours to make a graphite fiber reinforced test panel having a longitudinal axis normal to the plies. The transverse tensile test was run by placing the sample under tension along this longitudinal axis. The shear strength was tested by spanning the sample across two spaced apart support points and loading the sample from the opposite side.

The following examples of treatments in accordance with the invention include the temperature and stretch conditions of Subset D above, but all show substantially superior composite results. The precursor was again Enka 4400 denier rayon, and in each instance the graphitic fibers had modulus values of $40 \times 10^6$ psi.

times were approximately 0.57 and 0.21 seconds respectively. Due to the resistance heating, a yarn is uniformly heated in a few milliseconds to desired substantially fixed temperature levels in the different zones, and cooling also occurs in milliseconds. One consequence is that the fibers retain substantial reactivity in reaching the transitional phase, and as another consequence high modulus and tensile values are imparted without degradation of surface reactivity by maintenance of high fiber temperatures for long time periods. Other examples have been run at speeds of 24 fpm, with first zone span lengths of 8 inches, while the second zone span lengths remained 1.5 inches, the results being generally comparable. However, if the residence times are excessively shortened below 200 milliseconds or substantially lengthened the significant desired properties of modulus and tensile strength are affected. In accordance with the invention, residence times in a two zone system are limited to about 5 seconds or less in the first zone and about 1 second or less in the second zone. Additional zones may be employed in accordance with the invention but the residence times should be treated in a cumulative fashion, with shorter times allotted at higher temperatures.

| | | Proc. Temp. Stretch (°C)/amps | | (%) | TVT (psi) | Shear (psi) | Reagent Treatment |
|---|---|---|---|---|---|---|---|
| EXAMPLE I | $Z_1$ | 1830 | 8.3 | 20 | 5200–5400 | 11,700–13,500 | .15% aqueous solution of potassium carbonate |
| | $Z_2$ | 2732 | 8.3 | 15 | | | |
| EXAMPLE II | $Z_1$ | 1830 | 8.3 | 20 | 5100–5200 | 13,300–14,900 | .15% aqueous solution of cobalt sulfate |
| | $Z_2$ | 2732 | 8.3 | 15 | | | |
| EXAMPLE III | $Z_1$ | 1830 | 8.3 | 20 | 5500–5900 | 12,200–12,900 | .15% each nickel nitrate & sodium hypochlorite |
| | $Z_2$ | 2732 | 8.3 | 15 | | | |
| EXAMPLE IV | $Z_1$ | 1830 | 8.3 | 20 | 4600–5400 | 11,700–12,900 | .30% aqueous solution of oxalic acid |
| | $Z_2$ | 2732 | 8.3 | 15 | | | |

In Example III above, the mixture of nickel nitrate and sodium hypochlorite was a precipitate which was clarified with the use of a slight excess of HCL. The method of sample preparation and testing for composite properties was as described above. In each instance, the yarn was immersed in a bath of the solution while passing continuously between the two zones. The chemical reagent volatilized or reacted, or both, in the second zone. Volatile reagents such as oxalic acid create an active atmosphere encompassing the fibers. Salts such as cobalt sulfate solutions provide substantially in situ reactions, with some $SO_2$ being generated at the temperatures involved. Other reagents, such as potassium carbonate and the nickel nitrate and sodium hypochlorite mixture, provide compound reactions. In practice it has been found convenient and straightforward to utilize a very low flow of nitrogen in the second zone, so as to provide a slight positive pressure which precludes the introduction of air.

Short residence times in the two zones are of substantial importance in achieving both control and desired physical characteristics. The above examples were run at 35 fpm, with first span lengths (between the points of tangency with the electrode rollers) of 4 inches, and second span lengths of 1.5 inches. Thus the residence It should also be noted that the favorable temperature levels of the fibers in the zones are substantially fixed, both to impart maximum benefit from responsiveness to stretch in the zones and to establish control of properties such as modulus, tensile strength and reactivity. The first zone temperature of 1830° C. in the Examples is a relatively low value for imparting substantial stretch, but when improvements in composite properties are sought it will generally be preferred to lower this temperature even further. The second zone temperature should be as low as possible consistent with the modulus desired. In the examples, the final temperature of 2750° C. is well below the 2900–3100° C. value heretofore used by most workers in the art who seek high modulus values, and yet the resultant fibers have 40 million psi modulus. It should be noted that the stretch imparted can be substantial in both zones, because it reflects comparison of final length to starting length, and would be significantly greater if shrinkage effects were included. Fibers of cellulosic origin have significant shrinkage tendencies in undergoing pyrolysis to a graphitic form, typically in the range of 10–25%. By imparting more than 15% actual stretch relative to starting length in the first zone at low temperatures, and more than 10% actual stretch in the second zone, the fibers can first be made stronger and more receptive to treatment with graphitization inhibiting reagents and then can be carried to a more graphitic level with minimum loss of surface reactivity, using the temperature-time relationships previously discussed.

Three additional examples are given for reference and comparison. Comparable stretch, temperature and residence time conditions were used, the results given representing averages of at least five runs.

| EXAMPLE | Average Transverse Tensile (psi) | Average Shear (psi) | Reagent |
|---|---|---|---|
| V | 4558 | 11455 | 0.15% aqueous solution of potassium dichromate |
| VI | 5115 | 13267 | 0.15% aqueous solution of cobalt sulfate |
| VII | 5234 | 11720 | 0.15% aqueous solution of potassium carbonate |

While there have been described above a number of modifications and variations in accordance with the invention, it will be appreciated by those skilled in the art that the invention encompasses all modifications falling within the scope of the appended claims.

What is claimed is:

1. A method of substantially graphitizing carbon material while maintaining a relatively high degree of reactivity in the material comprising the steps of:

subjecting carbonaceous fibrous material which is initially of at least partially carbon composition to a plurality of successive treatments until the material is of substantially graphitic composition, said treatments comprising heating the material to a selected substantially fixed temperature less than 1900° C. in the first treatment and higher than the temperature of preceding treatments in subsequent treatments and concurrently stretching the material relative to the starting length; and reacting the material during or before one of said treatments with a reactive agent selected from the group consisting of potassium carbonate, cobalt sulfate, a mixture of nickel nitrate and sodium hypochlorite, potassium dichromate and oxalic acid.

2. The method of claim 1, wherein each of said treatments is performed in a different zone of elevated temperature and the material is exposed to the reactive agent before entering one of the zones.

3. The method of claim 1, wherein each of said treatments is performed in a different zone of elevated temperature, and the material is immersed in the reactive agent in liquid form prior to entry into at least one of the zones, the reagent volatilizing in the immediately subsequent zone.

4. A process for graphitizing carbonaceous fibers comprising the steps of successively heating and concurrently stretching the fibers in each of a plurality of different treatment zones of successively higher temperature to produce substantially graphitic fibers, reacting the fibers with a reactive agent selected from the group consisting of potassium carbonate, cobalt sulfate, a mixture of nickel nitrate and sodium hypochlorite, potassium dichromate and oxalic acid in at least one of the zones, the temperature in the last of the zones being held at less than 2800° C.

5. In a process for graphitizing carbon fibers in which the fibers are heated in a first zone to a temperature less than 1900° C., and concurrently stretched, and thereafter heated in at least a second zone to a temperature greater than the temperature in the first zone and less than 2800° C., and concurrently stretched, to produce substantially graphitic fibers, the improvement comprising the step of applying a reactive agent to the fibers in at least one of the zones, the reactive agent being selected from the group consisting of potassium carbonate, cobalt sulfate, a mixture of nickel nitrate and sodium hypochlorite, potassium dichromate and oxalic acid.

6. The invention defined in claim 5, wherein the step of applying a reactive agent to the fibers occurs in the second zone.

7. The invention defined in claim 5, wherein the step of applying a reactive agent to the fibers comprises immersing the fibers in the reactive agent in liquid form prior to entry of the fibers into the second zone.

8. The method of preparing graphitic fibers having substantial tensile and modulus values and improved composite properties from partially carbonized fibers comprising the steps of:

heating the fibers at a substantially fixed first temperature above the temperature at which the fibers will stretch and less than 1900° C. for a time no greater than approximately 5 seconds;

concurrently stretching the fibers in excess of approximately 15% of their original length;

applying a liquid reagent to the fibers, the reagent being selected from the group consisting of potassium carbonate, cobalt sulfate, a mixture of nickel nitrate and sodium hypochlorite, potassium dichromate and oxalic acid;

heating the fibers at a substantially fixed second temperature high enough to volatilize the liquid reagent and less than 2800° C. for a time no greater than approximately 1 second while concurrently developing a desired degree of graphiticity within the fibers; and concurrently stretching the fibers in excess of 10% of their length prior to the second stretching.

9. The method as set forth in claim 8 above, wherein the fibers are yarn of cellulosic origin and the heating is resistive heating in a continuous sequence.

10. The method as set forth in claim 8 above, wherein the reagent volatilizes in the second zone, and wherein the method further includes the step of maintaining a positive pressure of inert gas at the fibers during the steps of heating and concurrently stretching to prevent the introduction of air.

11. The method as set forth in claim 9 above, wherein the first temperature is approximately 1830° C. and the first stretch is approximately 20%, and the second temperature is approximately 2730° C. and the second stretch is approximately 15%.

12. The method as set forth in claim 8 above, wherein the liquid reagent comprises an aqueous solution and the method includes the step of continuously moving the fibers through the liquid reagent and through the successive heating and stretching steps.

13. The method as set forth in claim 8 above, wherein the liquid reagent comprises cobalt sulfate.

14. The method as set forth in claim 8 above, wherein the liquid reagent comprises potassium dichromate.

15. The method as set forth in claim 12 above, wherein the aqueous solution has a concentration of liquid reagent in the range of about 0.15% to 0.3%.

16. The method of treating partially carbonized fibers having 75–80% carbon to derive graphitic fibers comprising the steps of:

resistively heating a moving short span of the fibers at a first fixed temperature level below approximately 1900° C. for no greater than approximately 5 seconds;

concurrently stretching the fibers in excess of 15% of their length;

treating the fibers with an agent selected from the group consisting of potassium carbonate, cobalt sulfate, a mixture of nickel nitrate and sodium hypochlorite, potassium dichromate and oxalic acid;

resistively heating a moving short span of the treated fibers at a second fixed temperature level greater than the first fixed temperature level and below approximately 2800° C. for no greater than approximately 2 seconds to produce substantially graphitic fibers; and concurrently stretching the fibers in excess of 10% of their length.

17. The method as set forth in claim 16 above, wherein the short spans of the fibers are approximately 8 inches or less and approximately 1.5 inches or less in the successive heating steps.

18. The method as set forth in claim 17 above, wherein the fibers have been partially carbonized to approximately 400° C.

19. The method as set forth in claim 24 above, wherein the fibers are in yarn form and are continuously passed through the successive steps, and the step of treating the fibers with an agent comprises immersing the yarn in the reagent in liquid form between successive heatings and volatilizing the reagent during the subsequent heating.

* * * * *

UNITED STATES PATENT OFFICE

CERTIFICATE OF CORRECTION

PATENT NO. : 3,976,746

DATLD : August 24, 1976

INVENTOR(S) : Irvin Wizon

It is certified that error appears in the above-identified patent and that said Letters Patent are hereby corrected as shown below:

Column 10, line 13, "24" should read --18--.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*